US005672066A

United States Patent [19]

Yeung

[11] Patent Number: 5,672,066

[45] Date of Patent: Sep. 30, 1997

[54] ELECTRIC TRANSFORMER

[76] Inventor: Peter Yeung, 4251, Francis St., Vancouver B.C., Canada

[21] Appl. No.: 587,022

[22] Filed: Jan. 16, 1996

[51] Int. Cl.[6] ..... H01R 13/652

[52] U.S. Cl. ..... 439/107; 439/651; 307/147

[58] Field of Search ..... 439/956, 189, 439/217, 225, 651; 307/147, 149–151, 143, 43; 363/143

[56] References Cited

U.S. PATENT DOCUMENTS

| | | | |
|---|---|---|---|
| 2,994,849 | 8/1961 | Mussari, Jr. | 439/956 |
| 3,938,068 | 2/1976 | Hagan | 439/956 |
| 4,053,788 | 10/1977 | Robie | 439/956 |
| 4,131,805 | 12/1978 | Austin et al. | 439/956 |
| 5,071,370 | 12/1991 | Kochan, Jr. | 439/651 |

*Primary Examiner*—Gary F. Paumen
*Attorney, Agent, or Firm*—Browdy and Neimark

[57] ABSTRACT

An electrical transformer having a housing. The housing having a back plate with an upper set of prongs and a lower set of prongs. The upper set having a first prong, a second prong and a ground prong. The lower set having a third prong, a fourth prong and a ground prong. The housing further having a front plate provided with a first set of inlets having a first inlet, a second inlet and a ground inlet. The first inlet is connected with the second prong of the upper set of prongs. The second inlet is connected with the fourth prong of the lower set of prongs. The ground inlet is connected with the ground prong of the upper set of prongs.

2 Claims, 4 Drawing Sheets

ELECTRIC TRANSFORMER

FIELD OF THE INVENTION

The present invention relates generally to an electrical equipment, and more particularly to a transformer.

BACKGROUND OF THE INVENTION

Household electric appliances are generally run on electric power of 120 volts in Canada, with the exception of refrigerators which are run on the electric power of 240 volts. On the other hand, household electric appliances are run on electric power of 240 volts in Hong Kong. These two different situations are indicative of the fact that the electric power is used in a divergent manner around the world. It is therefore readily apparent that a portable transformer would be a very useful and helpful adjunct to electric appliances.

SUMMARY OF THE INVENTION

It is therefore the primary objective of the present invention to provide a transformer capable of converting electric power from 120 volts outlets into electric power of 240 volts without causing a reduction in power in the course of the voltage conversion.

The technical details of the present invention will be readily understood upon a thoughtful deliberation of the following detailed description of embodiments of the present invention in conjunction with the accompanying drawings.

DETAILED DESCRIPTION OF THE INVENTION

Figure 1:
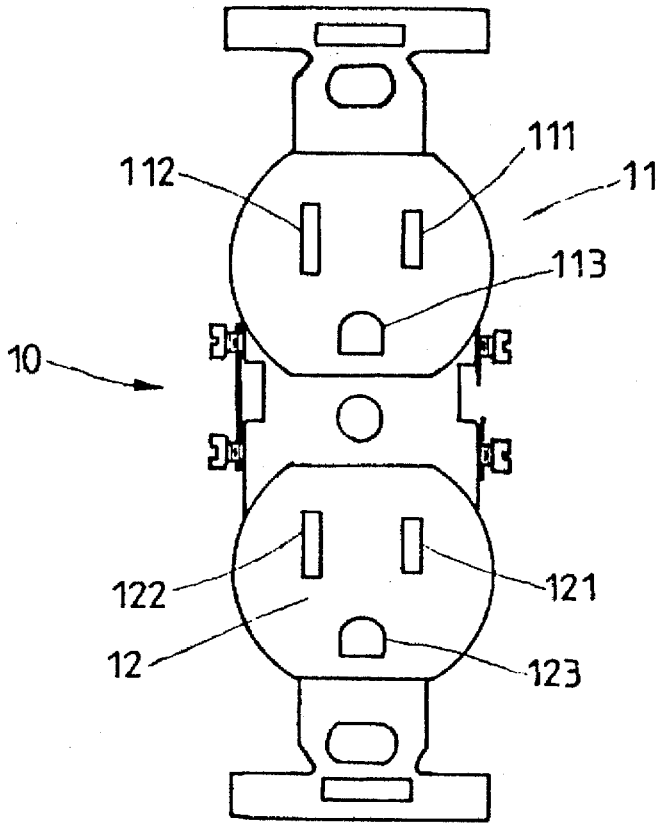
FIG.1 (PRIOR ART)
FIG. 1 is a schematic view of a power socket in a typical Canadian kitchen.

As shown in FIG. 1, a Canadian power socket 10 comprises an upper set of inlets 11 and a lower set of inlets 12 each for supplying electric power of 120 volts. The upper set of inlets 11 has a first inlet 111, a second inlet 112, and a ground inlet 113. The lower set of inlets 12 has a third inlet 121, a fourth inlet 122, and a ground inlet 123. The second inlet 112 is electrically connected with the fourth inlet 122.

Figure 2:
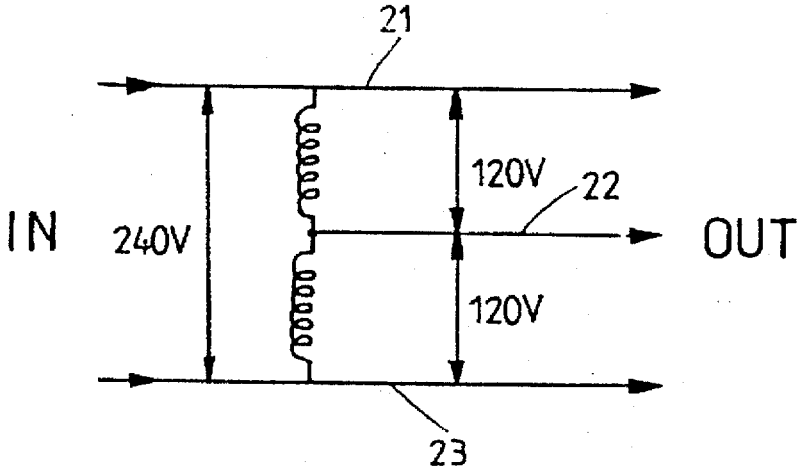
FIG.2 (PRIOR ART)
FIG. 2 is a schematic view of the connection wires of a typical indoor power source box used in Canada.
Figure 3:
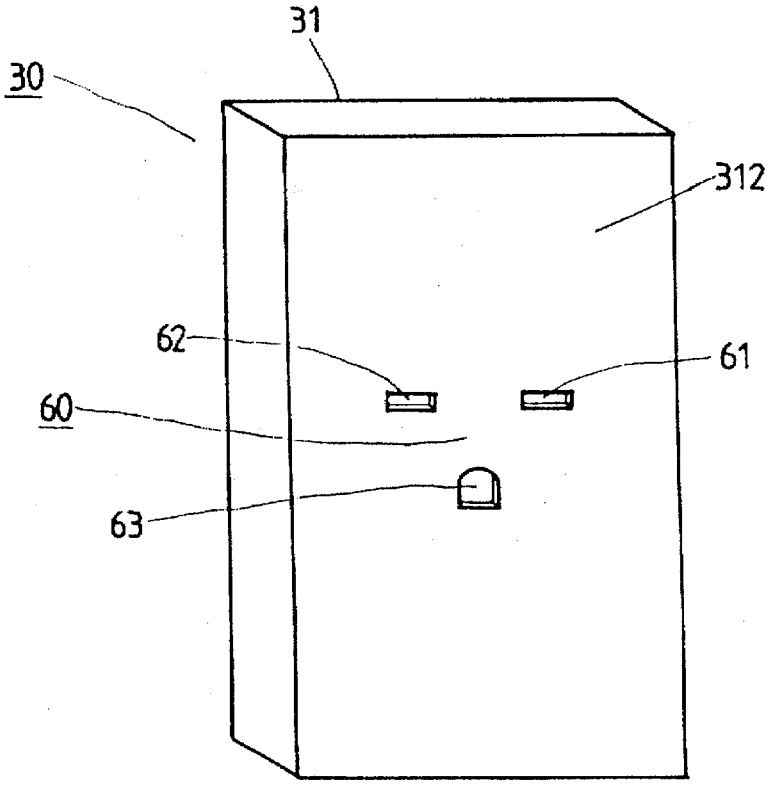
FIG. 3 is a perspective view of the present invention.
Figure 4:
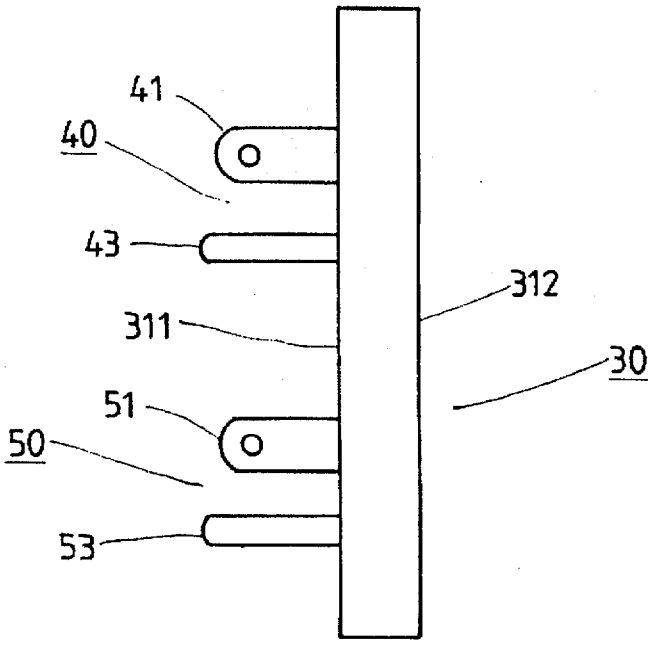
FIG. 4 is a side view of the present invention.
Figure 5:
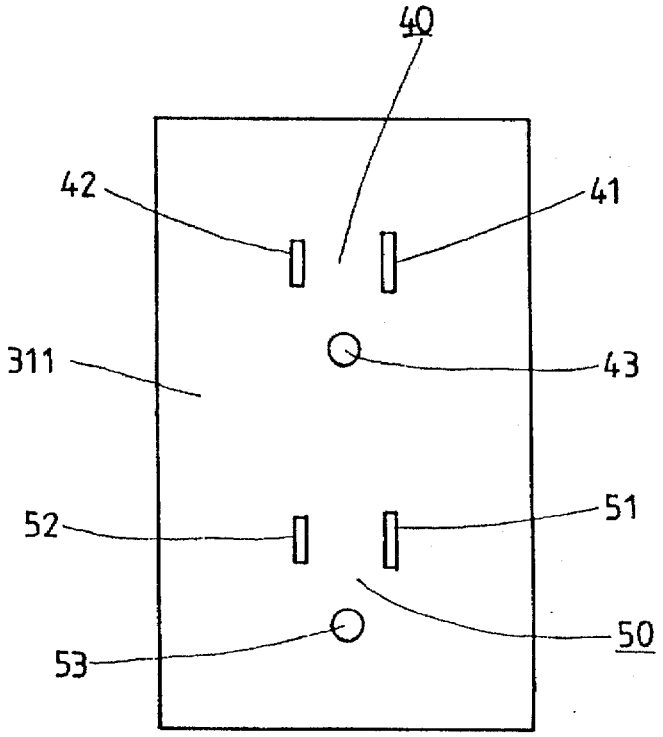
FIG. 5 is a rear view of the present invention.

As shown in FIG. 2, a Canadian power source box comprises a red first wire 21, a black second wire 22, and a white third wire 23.

The first inlet 111 of the upper set of inlets 11 is connected with the first wire 21 of the power source box. The second inlet 112 of the upper set of inlets 11 and the fourth inlet 122 of the lower set of inlets 12 are connected with the third wire 23. The third inlet 121 of the lower set of inlets 12 is connected with the second wire 22.

As shown in FIG. 3–6, a transformer 30 of the present invention comprises a housing 31 which has a back plate 311 provided with an upper set of prongs 40 and a lower set of prongs 50. The upper set of prongs 40 has a first prong 41, a second prong 42, and a ground prong 43. The lower set of prongs 50 has a third prong 51, a fourth prong 52, and a ground prong 53. The housing 31 further has a front plate 312 provided with a first set of inlets 60 having a first inlet 61, aa second inlet 62, and a ground inlet 63. The housing 31 houses therein the first inlet 61 electrically connected with the second prong 42 of the upper set of prongs 40 while the second inlet 62 is connected with the fourth prong 52 of the lower set of prongs 50. The ground inlet 63 is connected with the ground prong 43 of the upper set of prongs 40.

In operation, the transformer 30 of the present invention is mounted on the socket 10 of FIG. 1. As a result, the first set of inlets 60 of the housing 31 of the transformer 30 of the present invention is able to supply 240 volts of power directly to a household appliance without using a power source transformer. This minimizes a power loss brought about during a voltage conversion.

Figure 7:
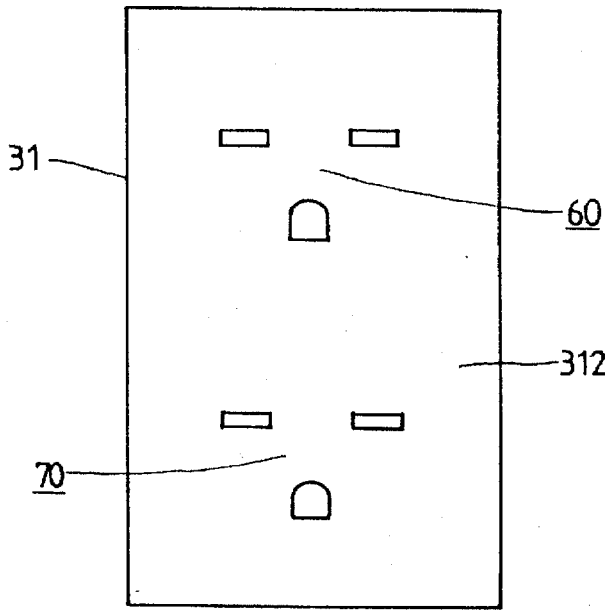
FIG. 7 is a rear view of another preferred embodiment of the present invention.
Figure 6:
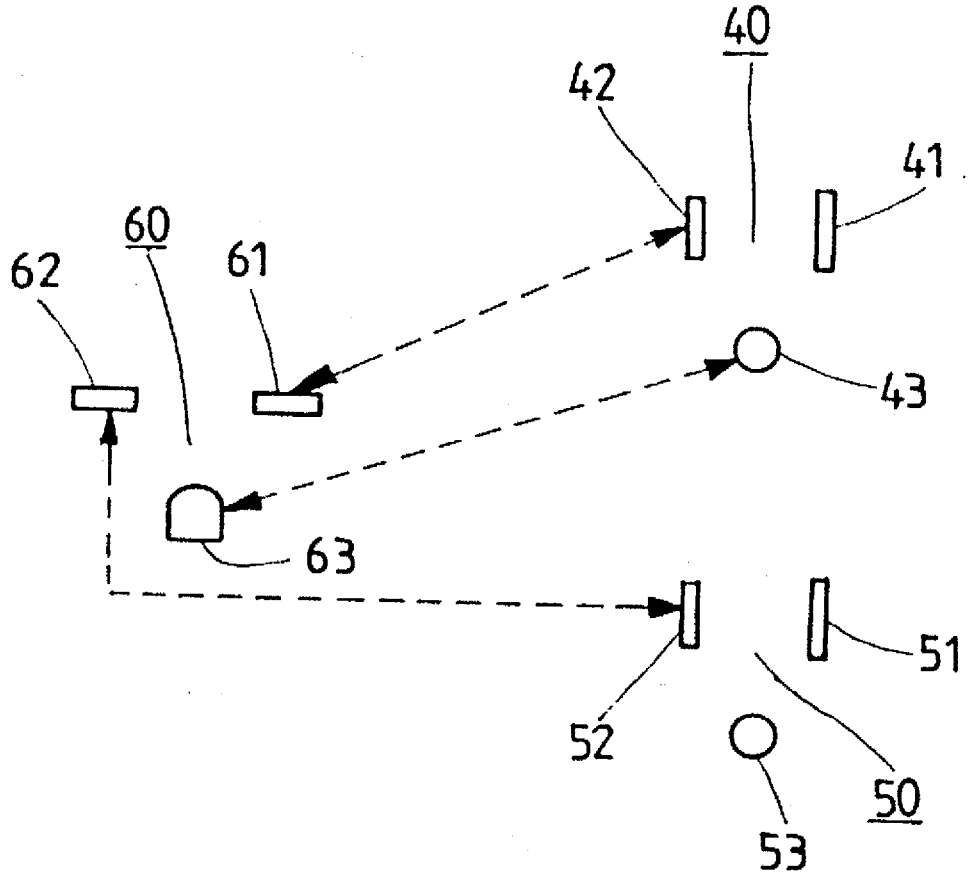
FIG. 6 is a schematic view of connection wires of the present invention.

As shown in FIG. 7, another preferred embodiment of the present invention comprises a housing 31 which is provide in the front side thereof with a first set of inlets 60 and one or more second sets of inlets 70, which are arranged in a parallel manner.

The embodiments of the present invention described above are to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. An electrical transformer having a housing with a receiving space therein, said housing comprising a back plate provided with an upper set of prongs and a lower set of prongs, said upper set of prongs having a first prong, a second prong and a first ground prong, said lower set of prongs having a third prong, a fourth prong and a second ground prong, said housing further comprising a front plate provided with a first set of inlets having a first inlet, a second inlet and a ground inlet, said first inlet being electrically connected with said second prong of said upper set of prongs, said second inlet being electrically connected with said fourth prong of said lower set of prongs and said ground inlet being electrically connected with said first ground prong of said upper set of prongs.

2. An electrical transformer according to claim 1, wherein said housing is provided in said front plate thereof with one or more additional sets of inlets each parallel to said first set of inlets.

* * * * *